US010340613B2

(12) United States Patent
Geske et al.

(10) Patent No.: US 10,340,613 B2
(45) Date of Patent: Jul. 2, 2019

(54) CONNECTION TERMINAL

(71) Applicant: Phoenix Contact GmbH & Co. KG, Blomberg (DE)

(72) Inventors: Ralf Geske, Schieder-Schwalenberg (DE); Simon Follmann, Extertal (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 92 days.

(21) Appl. No.: 15/535,735

(22) PCT Filed: Dec. 11, 2015

(86) PCT No.: PCT/EP2015/079446
§ 371 (c)(1),
(2) Date: Jun. 14, 2017

(87) PCT Pub. No.: WO2016/096658
PCT Pub. Date: Jun. 23, 2016

(65) Prior Publication Data

US 2018/0358715 A1 Dec. 13, 2018

(30) Foreign Application Priority Data

Dec. 18, 2014 (DE) ..... 10 2014 119 030

(51) Int. Cl.
*H01R 4/48* (2006.01)
*H01R 13/629* (2006.01)
(Continued)

(52) U.S. Cl.
CPC ..... *H01R 4/4845* (2013.01); *H01R 4/4836* (2013.01); *H01R 13/62955* (2013.01); *H01R 9/26* (2013.01); *H01R 12/515* (2013.01)

(58) Field of Classification Search
CPC .. H01R 4/4845; H01R 4/4827; H01R 4/4836; H01R 13/62955
(Continued)

(56) References Cited

U.S. PATENT DOCUMENTS 6,261,120 B1 * 7/2001 Beege ..... H01R 4/4836 439/268
6,682,364 B2 * 1/2004 Cisey ..... H01R 9/2666 439/441
(Continued)

FOREIGN PATENT DOCUMENTS

DE 2826978 DE 2/1979
DE 102008039232 A1 2/2010
(Continued)

*Primary Examiner* — Edwin A. Leon
*Assistant Examiner* — Milagros Jeancharles
(74) *Attorney, Agent, or Firm* — Leydig, Voit & Mayer, Ltd.

(57) ABSTRACT

A connection terminal includes a housing; an insertion opening, which is arranged on the housing and into which a conductor can be inserted in an insertion direction; a contact element, which is arranged on the housing and with which the conductor can be brought into contact by insertion into the insertion opening; a spring element, which is arranged on the housing, is held on the housing by a spring body, and has a resiliently movable spring leg extending from the spring body, wherein the spring leg clamps the conductor inserted into the insertion opening to the contact element in a clamping position; and an actuating element, which is arranged on the housing and can be actuated in an actuation direction to move the spring leg out of the clamping position, wherein the actuating element can be locked to the housing in an open position.

11 Claims, 4 Drawing Sheets

(51) Int. Cl.
*H01R 9/26* (2006.01)
*H01R 12/51* (2011.01)

(58) Field of Classification Search
USPC ..... 439/786, 806, 816–818, 824, 828
See application file for complete search history.

(56) References Cited

U.S. PATENT DOCUMENTS

| | | | | |
|---|---|---|---|---|
| 8,062,079 | B2 * | 11/2011 | Hoppmann | H01R 4/4836 439/834 |
| 8,251,738 | B2 * | 8/2012 | Heckert | H01R 4/4836 439/441 |
| 8,262,405 | B1 * | 9/2012 | Bishop | H01R 4/4845 439/439 |
| 2002/0187670 | A1 | 12/2002 | Cisey | |
| 2012/0238154 | A1 | 9/2012 | Bishop | |
| 2013/0157520 | A1 * | 6/2013 | Koellmann | H01R 4/4836 439/834 |
| 2014/0227914 | A1 | 8/2014 | Tedeschi | |
| 2016/0211591 | A1 * | 7/2016 | Herrmann | H01R 4/4836 |

FOREIGN PATENT DOCUMENTS

| | | | |
|---|---|---|---|
| DE | 102010025930 | A1 | 1/2012 |
| EP | 0106227 | A1 | 4/1984 |
| EP | 1258950 | A1 | 11/2002 |
| EP | 2500982 | A1 | 9/2012 |

* cited by examiner

CONNECTION TERMINAL

CROSS-REFERENCE TO PRIOR APPLICATIONS

This application is a U.S. National Phase application under 35 U.S.C. § 371 of International Application No. PCT/EP2015/079446, filed on Dec. 11, 2015, and claims benefit to German Patent Application No. DE 10 2014 119 030.0, filed on Dec. 18, 2014. The International Application was published in German on Jun. 23, 2016 as WO 2016/096658 under PCT Article 21(2).

FIELD

The invention relates to a connection terminal having a housing, an insertion opening and a contact element.

BACKGROUND

A connection terminal of this type is used for connecting a conductor in an electrically contacting manner. A connection terminal of this type may, for example, be used on a printed circuit board as a print terminal to connect a conductor to the printed circuit board or as series terminals to electrically connect a plurality of conductors to one another. Basically, connection terminals of the type discussed herein can be used for completely different purposes and in completely different embodiments.

A connection terminal of this type comprises a housing, an insertion opening, which is arranged on the housing and into which a conductor can be inserted in an insertion direction, and a contact element, which is arranged on the housing and with which the conductor can be brought into contact by insertion into the insertion opening. Furthermore, a spring element is arranged on the housing and is held on the housing by means of a spring body and has a resiliently movable spring leg extending from the spring body. This spring leg is configured to clamp a conductor inserted into the insertion opening to the contact element in a clamping position in such a way that the conductor is held on the contact element in an electrically contacting manner.

To allow simple insertion of a conductor into the insertion opening in a manner requiring little force, arranged on the housing is an actuating element, which can be actuated in an actuation direction to move the spring leg out of the clamping position. By actuating the actuating element, the spring leg can therefore be removed from the contact element so a conductor can easily and without a great expenditure of force be pushed into the insertion opening into a position between the contact element and the spring leg and can be clamped to the contact element by means of the spring leg.

Likewise, the actuating element can be actuated to release a conductor from the connection terminal. By removing the spring leg from the contact element and by cancelling the clamping connection, the conductor can easily be pulled out of the insertion opening.

Because it can be laborious to hold an actuating element in position manually or using a suitable tool so as to place a conductor on the connection terminal, it is provided in a connection terminal known from DE 10 2008 039 232 A1 to lock the actuating element to the housing of the connection terminal in an open position, in which the spring leg is moved out of the clamping position. When the actuating element is pressed into the housing in the actuation direction, the actuating element acts on the spring leg of the connection terminal and presses it out of its clamping position, wherein the actuating element locks to the housing and is thereby held in its open position. This therefore, in a simple manner, allows a conductor to be positioned on the connection terminal or to be removed from the connection terminal, wherein after positioning the conductor or after removal of the conductor, the locking of the actuating element to the housing can in turn be released to return the spring leg into its clamping position.

SUMMARY

In an embodiment, the present invention provides a connection terminal, comprising: a housing; an insertion opening, which is arranged on the housing and into which a conductor can be inserted in an insertion direction; a contact element, which is arranged on the housing and with which the conductor can be brought into contact by insertion into the insertion opening; a spring element, which is arranged on the housing, is held on the housing by a spring body, and has a resiliently movable spring leg extending from the spring body, wherein the spring leg is configured to clamp the conductor inserted into the insertion opening to the contact element in a clamping position; and an actuating element, which is arranged on the housing and is configured to be actuated in an actuation direction to move the spring leg out of the clamping position, wherein the actuating element is configured to be locked to the housing in an open position, in which the spring leg is moved out of the clamping position, wherein the actuating element, to move the spring leg, is configured to act on a distal end of the spring leg, the distal end being remote from the spring body.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
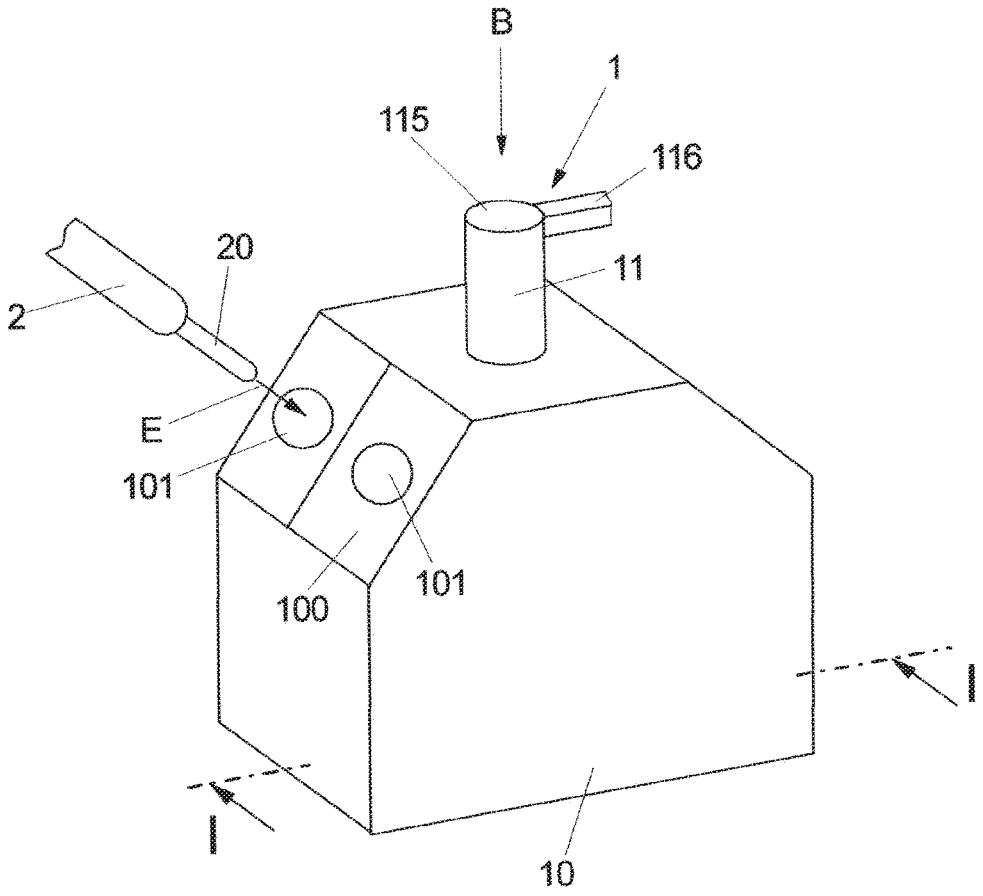
FIG. 1 is a schematic view of a connection terminal.

In an embodiment, it is provided that the actuating element, to move the spring leg, acts on a distal end of the spring leg, said distal end being remote from the spring body.

Since the actuating element acts on the distal end of the spring leg, the action of force between the actuating element and the spring leg, and therefore also the haptics when actuating the actuating element, are improved. In particular, the actuating element operates in that it acts on the spring element under a comparatively large lever, on the distal end of the spring leg remote from the spring body, so the force to be applied to the actuating element can be reduced.

Because the action point between the actuating element and spring leg is at the distal end, the loading of the spring element, in particular the spring leg, is also reduced.

The cooperation between the actuating element and spring leg can be further improved in that the actuation direction, along which the actuating element is to be actuated, and the insertion direction, in which a conductor is to be inserted into the connection terminal, are directed obliquely with respect to one another. This is because the spring leg is directed obliquely with respect to the contact element in the clamping position, the contact element preferably extending in an elongate manner along the insertion direction. As a result of oblique orientation of the actuation direction with respect to the insertion direction, the actuating element can act approximately perpendicularly on the spring leg to move the spring leg out of the clamping position. The spring leg and the actuation direction therefore extend approximately perpendicular to one another in the clamping position of the spring leg.

It may be advantageous here for the actuating element to engage through an opening of the contact element. The actuating element therefore extends through the contact element, so by pressing on the contact element, the spring leg can advantageously be removed from the contact element to pivot the spring leg out of the clamping position.

In a specific configuration, the actuating element comprises a shaft with a head, by means of which the actuating element can be actuated, and a foot portion remote from the head. By means of the foot portion, the actuating element acts on the distal end of the spring leg, while a user can act on the actuating element by means of the head, for example manually or using a suitable tool, for example a screwdriver.

To favorably act on the spring leg, the foot portion preferably has, on a side facing the spring leg, an abutment face, by means of which the foot portion abuts the spring leg. By suitable rounding of the foot portion (viewed in cross section in a pivoting plane, in which the spring leg can be pivoted), the foot portion can be adapted, in terms of its abutment face, to the spring leg, so the actuating element can act in a favorable manner on the spring leg by means of the foot portion upon a movement of the spring leg out of the clamping position and an accompanying pivoting of the spring leg relative to the spring body held on the housing.

In the open position of the connection terminal, in which the spring leg is moved out of the clamping position, the actuating element can be locked to the housing so the actuating element is held in its adopted position and the spring leg is therefore fixed in the open position. To lock the actuating element to the housing, the actuating element may, for example, have a locking projection on its head, said locking projection being able to be brought into locking engagement with an associated locking projection of the housing. On actuation of the actuating element to move the spring leg into the open position, the locking projection on the head of the actuating element engages in a locking manner with the locking projection on the housing, so the actuating element latches with the housing and the spring leg is thereby held in the open position.

The attachment of the locking projection of the actuating element on the head in other words on the end of the actuating element remote from the foot portion results in a large lever acting between the foot portion and the head, allowing an easy release of the locking between the actuating element and the housing. Thus, to release the locking of the actuating element to the housing, the actuating element can be pivoted around the advantageously rounded foot portion on the spring leg so as to disengage the locking projection of the actuating element from the locking projection of the housing without great expenditure of force.

The actuating element, in an advantageous embodiment, has, on its foot portion, an abutment projection, which, in cooperation with a projection of the housing, limits a movement path of the actuating element counter to the actuation direction. In the clamping position of the spring leg, in other words when the actuating element is not actuated, the abutment projection of the foot portion advantageously abuts the associated projection of the housing, so the actuating element is in a defined position on the housing. By actuating the actuating element in the actuation direction, the abutment projection of the foot portion is removed from the associated projection of the housing, so, in the open position, the abutment projection does not abut the projection.

In a further advantageous embodiment, the abutment projection on the foot portion of the actuating element and the locking projection on the head of the actuating element are arranged on different sides of the actuating element. While the abutment projection is arranged on a first side of the actuating element, the latching projection is formed on an opposing, second side of the actuating element (with reference to the actuation direction).

By actuating the actuating element, the spring leg is pivoted out of its clamping position. This takes place with resilient bracing of the spring leg, which means that the spring leg exerts a restoring spring force on the actuating element in the open position. This spring force acting in the open position is preferably directed obliquely with respect to the actuation direction in that one directional vector component of the restoring spring force acts counter to the actuation direction and a further, second directional vector component of the spring force acts transverse to the actuation direction.

The directional vector components in this context are to be taken to mean the vector components of the spring force. The spring force is directed and is therefore a vector that can be resolved into vector components. Since one directional vector component acts counter to the actuation direction, the restoring spring force brings about a removal of the actuating element from the housing counter to the actuation direction when the locking between the actuating element and the housing is released.

The directional vector component acting transverse to the actuation direction, on the other hand, on actuation of the actuating element, acts to transfer the spring leg into the open position, preferably in the direction of bringing the actuating element into locking engagement with the housing, so the locking of the actuating element to the housing is automatically produced and is held in the open position of the spring leg in a catching manner.

To release the actuating element from its locking to the housing, a user can act on the actuating element in a release direction directed transverse to the actuation direction, it being possible for this to take place manually or using a tool. By acting on the actuating element, the locking projection of the actuating element is pushed out of engagement with the associated locking projection of the housing, this advantageously taking place by rolling the foot portion of the actuating element on the spring leg and therefore by pivoting the actuating element in the housing.

FIG. 1, in a schematic view, shows an embodiment of a connection terminal 1, which has a housing 10 with insertion openings 101 formed on a housing face 100 for plugging in one or more electric conductors 2. Here, a line end 20 of an electric conductor 2 can be inserted into each insertion opening 101 in an insertion direction E in order to be electrically contacted within the housing 10 and thereby to be electrically connected, for example to a printed circuit board to which the connection terminal 1 is connected.

Figure 2A:
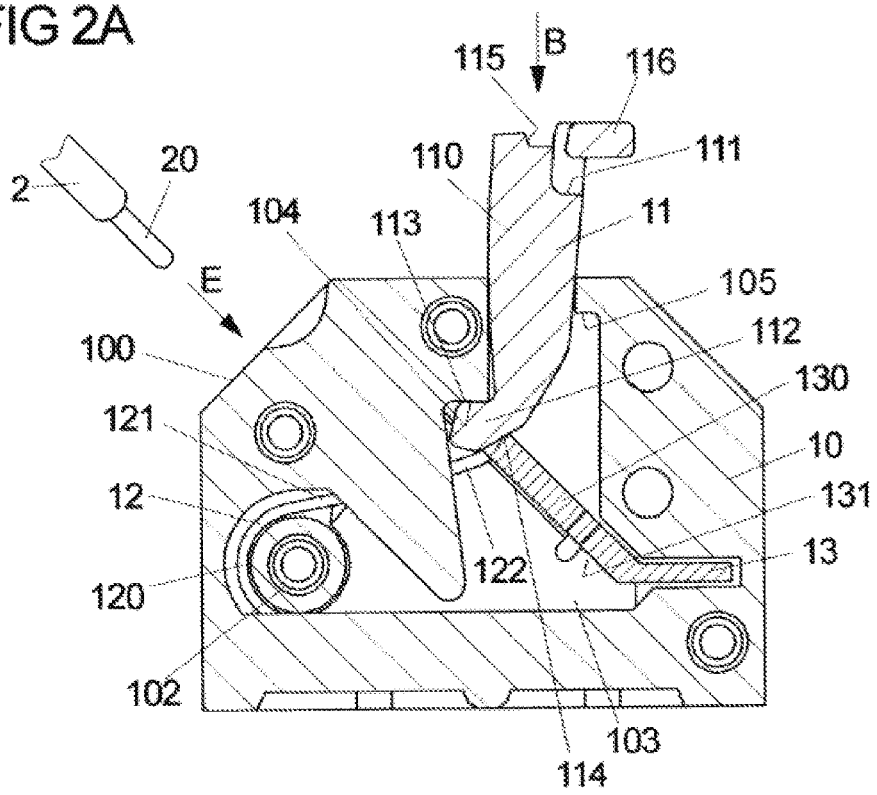
FIG. 2A is a sectional view through the connection terminal along the line I-I according to FIG. 1, showing the connection terminal in a clamping position of a spring leg of a spring element.
Figure 2B:
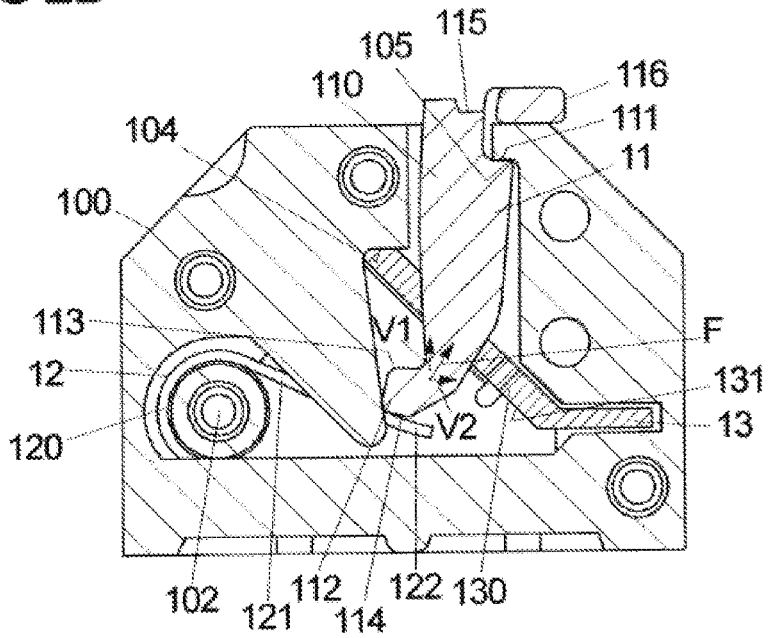
FIG. 2B is the view according to FIG. 2A but with the spring leg in an open position, in which the spring leg is held by means of an actuating element that locks to the housing.
Figure 2C:
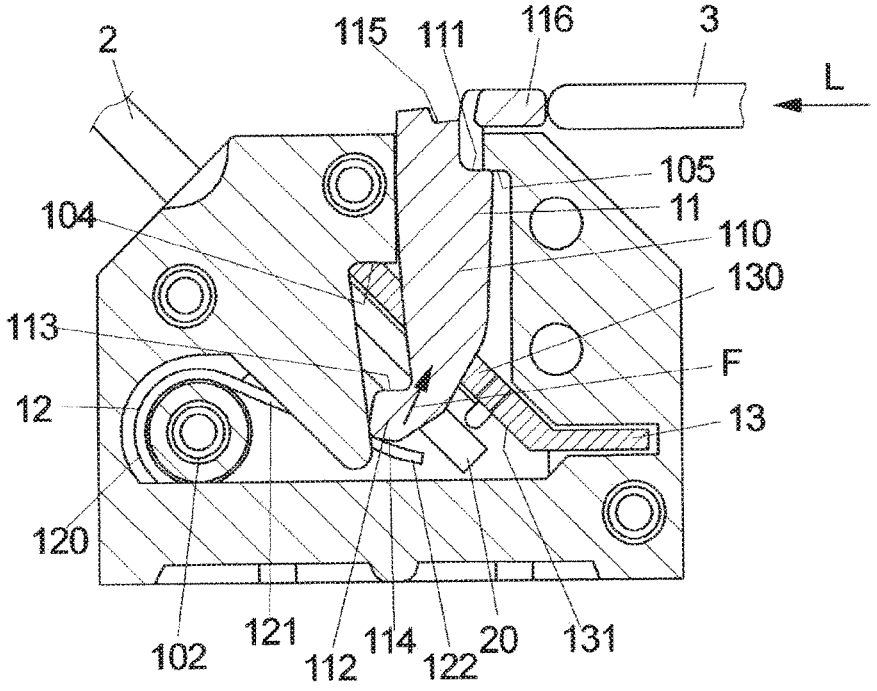
FIG. 2C is the view according to FIG. 2B on release of the actuating element from the locking to the housing.

FIG. 2A to 2C are sectional views along a line I-I of the connection terminal 1 shown schematically in FIG. 1. A spring element 12 in the form of a leg spring is arranged within the housing 10 and is held stationary and non-rotatable with respect to the housing 10 by a spring body 120 on a spring holder 102 in such a way that the spring body 120 is fixed with respect to the housing 10 but a spring leg 121 extending from the spring body 120 can be pivoted within a space 103 of the housing 10.

The spring leg 121 of the spring element 12 is used to clamp a line end 20 of a conductor 2, which line end is inserted into an insertion opening 101 so as to be electrically contacted with a metallic, electrically conductive contact element 13. The contact element 13 is rigidly arranged within the housing 10 and extends with a clamping face 131 approximately along the insertion direction E within the housing 10.

The spring element 12 with its spring leg 121 can adopt different positions within the housing 10. In a clamping position, shown in FIG. 2A, the spring leg 121 is close to the clamping face 131 of the contact element 13. The spring leg 121 seeks this clamping position when a line end 20 of a conductor 2 is inserted into the housing 10, so the line end 20 is clamped between the spring leg 121 and the clamping face 131 of the contact element 13.

In order to be able to insert the line end 20 of a conductor 2 into the housing 10 easily and without great expenditure of force, the spring leg 121 can be pivoted out of its clamping position by an actuating element 11 arranged on the housing 10. The actuating element 11 is movably arranged on the housing 10 along an actuation direction B and has a shaft 110, which is arranged with its foot portion 112 within the space 103 of the housing 10 and projects with a head 115 out of the housing 10.

The actuating element 11 is configured to act with its foot portion 112 on a distal end 122 of the spring leg 121, said distal end being remote from the spring body 120. For this purpose, the foot portion 112, on a side facing the spring leg 121, has an abutment face 114, which is in contact with the distal end 122 of the spring leg 121.

In order to move the spring leg 121 out of its clamping position, a user can act on the actuating element 11 in the actuation direction B and press it into the housing 10, for example manually or using a suitable tool, for example a screwdriver. As a result, the actuating element 11 presses with its foot portion 112 on the distal end 122 of the spring leg 121 so the spring leg 121 is pivoted around the spring holder 102 and is removed from the contact element 13, as shown in FIG. 2B.

Formed on the head 115 of the actuating element 11 is a locking projection 111, which, on actuation of the actuating element 11 in the actuation direction B, engages with an associated locking projection 105 on the housing 10, as shown in FIG. 2B. The actuating element 11, after insertion into the housing 10, is thus locked to the housing 10, so the actuating element 11 remains in the adopted position and holds the spring leg 121 in this open position of the connection terminal 1.

Because in this position the spring leg 121 is removed from the clamping face 131 of the contact element 13, the line end 20 of a conductor 2 can easily be inserted into the housing 10 through an insertion opening 101 of the housing 10, as shown in FIG. 2C.

In order to clamp the line end 20 of the conductor 2 within the housing 10 after insertion, the actuating element 11 can then be released from its locking by acting on a release tab 116 of the actuating element 11, by means of a suitable tool 3 or else manually, in a release direction L directed transverse to the actuation direction B. As a result, the locking projection 111 at the head 115 of the actuating element 11 can be disengaged from the associated latching projection 105 on the housing 10, as shown in FIG. 2C, so the actuating element 11, because of the restoring spring force F acting as a result of the spring leg 121, is removed from the housing 10 counter to the actuation direction B.

On actuation of the actuating element 10 in the actuation direction B, the spring leg 121 is moved within the housing 10 and thus resiliently tensioned. The actuation of the actuating element 11 therefore takes place counter to the spring force of the spring leg 121. Because the actuating element 11 acts with its foot portion 112 on the distal end 122 of the spring leg 121, comparatively small forces are necessary, however, to move the spring leg 121, so the expenditure of force to be applied by a user to actuate the actuating element 11 is comparatively small.

The required expenditure of force is further reduced in that the actuation direction B is directed at least approximately perpendicular to the extension direction of the spring leg 121 in the clamping position, as can be seen from FIG. 2A. Thus, the actuating element 11, on actuation under favorable lever conditions, acts on the spring leg 121.

When the spring leg 121 is moved into its open position, as shown in FIG. 2B, a restoring spring force F acts, which can be vectorially resolved into directional vector components V1, V2. Here, a first directional vector component V1 acts counter to the actuation direction B, while a different, second directional vector component V2 is directed transverse to the actuation direction B. Here, the transversely directed directional vector component V2 acts in such a way that it loads the actuating element 11 in the direction of bringing the locking projection 111 on the head 115 into engagement with the associated latching projection 105 on the housing 10. This at least assists the production of the locking of the actuating element 11 to the housing 10 and also brings about a catching of the actuating element 11 in its locked position, so the locking cannot easily be released, in particular not automatically.

The foot portion 112 is rounded on its abutment face 114 or formed in such a way that it is adapted to the bent shaping at the distal end 122 of the spring leg 121. As a result, an advantageous abutment of the foot portion 112 on the distal end 122 along the entire movement path of the spring leg 121 is achieved.

The abutment face 114 is also a tilting point of the actuating element 11, around which the actuating element 11 can be tilted to release the lock, as shown in FIG. 2C. The release of the locking can therefore also be carried out in a haptically pleasant manner without great expenditure of force.

To limit the movement path of the actuating element 11 counter to the actuation direction B, the foot portion 112 of the actuating element 11 is hook-shaped and has an abutment projection 113, which points toward an associated projection 104 on the housing 10 counter to the actuation direction B. In the clamping position of the spring leg 121, shown in FIG. 2A, this abutment projection 104 abuts the associated projection 113 on the housing 10, so the actuating element 11 is in a defined position on the housing 10, beyond which the actuating element 11 cannot be moved out of the housing 10.

The action of the actuating element 11 under favorable lever conditions on the spring leg 121 extending at least approximately at a right angle to the actuation direction B in the clamping position becomes possible because the insertion direction E, in which the line end 20 of a conductor 2 is to be inserted into the housing 10, is directed obliquely with respect to the actuation direction B, as can be seen from FIG. 2A. Specifically, the angle between the actuation direction B and the insertion direction E may, for example, be between 30° and 60°, for example 45°.

Because the actuating element 11 is to press the spring leg 121 away from the clamping face 131, which also extends obliquely with respect to the actuation direction B, it is necessary for the actuating element 11 to engage through the contact element 13 at an opening 130, so the actuating element 11 can act on the spring leg 121 located on the other side of the contact element 13 in the actuation direction B.

Here, the actuating element 11 is located outside an insertion path of a conductor 2 so a line end 20 of a conductor 2 can be inserted into the housing 10 past the actuating element 11, as illustrated in FIG. 2C.

Figure 3:
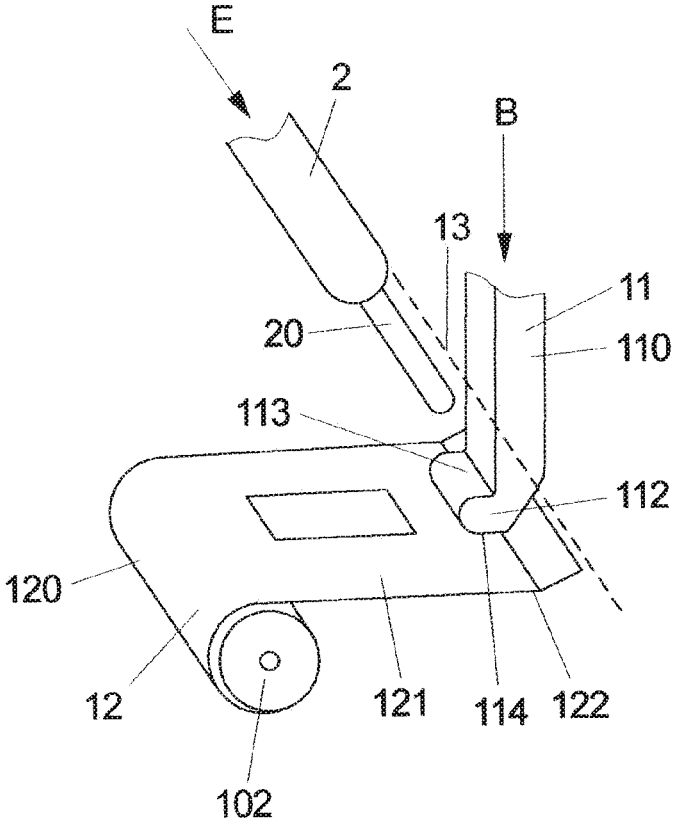
FIG. 3 is a schematic view of the spring element in cooperation with the actuating element.

In a schematic view, FIG. 3 shows an embodiment of a spring element 12 in cooperation with an actuating element 11. A spring element 12 of this type may, for example, be associated with two insertion openings 101 for clamping connection of two conductors 2 on a connection terminal 1.

The idea on which the invention is based is not limited to the embodiments described above, but can also be realized in a completely different way.

A connection terminal of the type described herein may be used, for example, on a printed circuit board for connecting a conductor to the printed circuit board. In this case, the connection terminal may have one or more insertion openings.

It is also conceivable to use a connection terminal in the form of a series terminal to connect a plurality of conductors to one another.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 connection terminal
10 housing
100 housing face
101 insertion opening
102 spring holder
103 space
104 projection
105 locking projection
11 actuating element
110 shaft
111 locking projection
112 foot portion (hook element)
113 abutment projection
114 abutment face
115 head
116 release tab
12 spring element
120 spring body
121 spring leg
122 distal end
13 contact element
130 opening
131 clamping face
2 conductor
20 line end
3 tool
B actuation direction
E insertion direction
F force direction
L release direction
V1, V2 directional vector component

The invention claimed is:

1. A connection terminal, comprising:

a housing;

an insertion opening, which is arranged on the housing and into which a conductor can be inserted in an insertion direction;

a contact element, which is arranged on the housing and with which the conductor can be brought into contact by insertion into the insertion opening;

a spring element, which is arranged on the housing, is held on the housing by a spring body, and has a resiliently movable spring leg extending from the spring body, wherein the spring leg is configured to clamp the conductor inserted into the insertion opening to the contact element in a clamping position; and an actuating element, which is arranged on the housing and is configured to be actuated in an actuation direction to move the spring leg out of the clamping position, wherein the actuating element is configured to be locked to the housing in an open position, in which the spring leg is moved out of the clamping position, wherein the actuating element, to move the spring leg, is configured to act on a distal end of the spring leg, the distal end being remote from the spring body, wherein the actuating element, in the open position, is configured to be moved in a release direction transverse to the actuation direction with respect to the housing so as to release the locking between the actuating element and the housing.

2. The connection terminal according to claim 1, wherein the actuation direction is directed obliquely with respect to the insertion direction.

3. The connection terminal according to claim 1, wherein the actuating element is configured to engage through an opening of the contact element.

4. The connection terminal according to claim 1, wherein the actuating element has a shaft with a head, by which the actuating element is configured to be actuated, and a foot portion remote from the head, wherein the actuating element is configured to act on the distal end of the spring leg via the foot portion.

5. The connection terminal according to claim 4, wherein the foot portion, on a side facing the spring leg, has an abutment face, via which the foot portion abuts the spring leg.

6. The connection terminal according to claim 4, wherein the foot portion, viewed in cross section in a pivoting plane, in which the spring leg is configured to be pivoted, is rounded on the abutment face.

7. The connection terminal according to claim 4, wherein the actuating element, in the region of its head, has a locking projection configured to lock to an associated locking projection of the housing in the open position.

8. The connection terminal according to claim 4, wherein the actuating element, on its foot portion, has an abutment projection, which, in cooperation with a projection of the housing, is configured to limit a movement path of the actuating element counter to the actuation direction.

9. The connection terminal according to claim 8, wherein the abutment projection and the locking projection are arranged on different sides of the actuating element.

10. The connection terminal according to claim 1, wherein the spring leg, in the open position, is configured to exert a spring force on the actuating element, which is directed with a first directional vector component counter to the actuation direction and with a second directional vector component transverse to the actuation direction.

11. The connection terminal according to claim 10, wherein the second directional vector component acts in the direction of bringing the actuating element into locking engagement with the housing.

* * * * *